United States Patent [19]

Jones et al.

[11] 4,358,315

[45] Nov. 9, 1982

[54] MANGANESE STEELS

[75] Inventors: Robert D. Jones, Cardiff, Wales; Vijay Jerath, Marton Middlesborough, England

[73] Assignee: University College Cardiff, Cardiff, England

[21] Appl. No.: 167,438

[22] Filed: Jul. 9, 1980

[30] Foreign Application Priority Data

Jul. 10, 1979 [GB] United Kingdom ..... 7923973

[51] Int. Cl.[3] ..... C22C 38/04

[52] U.S. Cl. ..... 75/123 N; 75/123 E; 75/123 J; 75/123 M; 75/124

[58] Field of Search ..... 75/123 N, 123 E, 123 J, 75/123 L, 123 M, 124

[56] References Cited

U.S. PATENT DOCUMENTS 2,129,346 9/1938 de Golyer ..... 75/123 N

FOREIGN PATENT DOCUMENTS 1159098 7/1969 United Kingdom .

*Primary Examiner*—R. Dean

*Attorney, Agent, or Firm*—Larson and Taylor

[57] ABSTRACT

This invention relates to manganese steels, in particular the invention relates to high strength iron-manganese based maraging-type steel combining high strength and toughness. Specifically, a manganese steel in accordance with the invention contains, apart from impurities, 11.8–13.5% by weight manganese, 2.0–6.0% by weight molybdenum, 0.002–0.2% by weight carbon, and optionally one or more of silicon (up to 0.4% by weight), sulphur (up to 0.02% by weight), and phosphorus (up to 0.03% by weight), and balance iron.

4 Claims, No Drawings

MANGANESE STEELS

This invention relates to manganese steels.

High strength steels, known as 'maraging steels', can be made by the addition of nickel (about 18%) and molybdenum (about 5%) to iron. These steels are considered to possess high strength combined with toughness. Heat treatment of these steels does not require a rapid quench so that large sections can be treated successfully, and decarburisation problems do not arise. The heat treatment, necessary to achieve their high strength is known as "maraging" and involves an initial solution treatment at 800°-900° C. followed by heating the steel at 450°-500° C. for a number of hours. It is the alloying content of the steel and, in particular the nickel, which produces high strength following the heat treatment. Since manganese has an effect similar of nickel when added to steel and since manganese is less expensive than nickel, it is of interest to attempt to replace nickel by manganese in steels of this type. Previous work by the inventors and by others has confirmed that steels based on various iron-manganese compositions with additions of elements such as molybdenum or silicon or titanium are capable of improvement in strength by a heat treatment of the maraging type. Unfortunately, as these steels become stronger they also become very brittle, an effect which clearly limits their usefulness. It is one object of this invention to provide a high strength iron-manganese based maraging-type steel combining high strength with acceptable toughness.

Metallic iron can exist in two forms of crystal structure, one known as face centred cubic ($\gamma$ phase) at temperatures between 910° C. and 1435° C. and one known as body centred cubic below 910° C. ($\alpha$ phase) and between 1435° C. and the melting temperature, the ($\delta$ phase) exists. The addition of alloying elements to iron changes the temperature ranges over which these phases are stable. For example, both nickel and manganese are considered to be $\gamma$-phase stabilising elements because they make the $\gamma$-phase stable at temperatures below 910° C. and above 1435° C. If sufficient nickel or manganese is added it is possible to produce an alloy steel whose crystal structure partly or completely comprises $\gamma$-phase at room temperature. Now the phenomenon of maraging depends in part on the transformation of a steel from a $\gamma$-phase structure to an $\alpha$-phase structure at temperatures relatively close to room temperature. (To be precise, the body centred phase formed near room temperature is usually designated $\alpha'$ because it forms by a shear rather than the usual diffusional mechanism and depending on the steel's carbon content may have a slightly body centred tetragonal crystal structure. In the following all body centred type phases are referred to as $\alpha$). The transformation effects a supersaturation of the $\alpha$-phase in whatever elements (for example molybdenum) have been added to the steel to achieve hardening during subsequent maraging at 450°-500° C. We have found that good toughness can be maintained during maraging to increase strength if the steel does not transform completely to an $\alpha$-phase structure but instead contains a certain amount of retained $\gamma$-phase (or $\epsilon$-phase which is known to form as a part of the transformation sequence in the iron-manganese system).

It can be envisaged that the dispersion of phases acts in two ways. Firstly, as the $\gamma/\epsilon$ phases cannot be maraged to higher strength they orm a set of crack arresting zones in the steel. Secondly, elements which are present in the steel at impurity levels and which may encourage the development of embrittlement in $\alpha$ phase are likely to be absorbed by the $\gamma/\epsilon$ phase zones and rendered harmless.

According to this invention we provide a manganese steel containing, apart from impurities, 11.8-13.5% by weight manganese, 2.0-6.0% by weight molybdenum, 0.002-0.2% by weight carbon, and optionally one or more of silicon (up to 0.4% by weight), sulphur (up to 0.02% by weight), and phosphorus (up to 0.03% by weight), and balance iron. If desired, molybdenum may be replaced partially or completely by 2 to 10 weight % tungsten without any significant loss in strength and toughness properties. Small additions for example up to 0.2%, of aluminum, titanium and/or mischmetal are also capable of improving the mechanical properties under certain conditions. To achieve the best results we propose, manufacturing the steels either by vacuum or air melting. The preferred heat treatment includes an initial solution treatment for a period depending on the section size, in the temperature range 800°-1100° C. The steel is then cooled from the solutin treatment temperature to room temperature at a rate which is non-critical. Before finally maraging to increase strength it may be necessary or desirable to subject the steel to sub-zero cooling by, for example, immersing in liquid nitrogen for a short time or by any of the well known conventional techniques, to establish a satisfactory ratio of $\alpha$ and $\gamma$ phases. Maraging is then carried out within the temperature range 400°-550° C. over a period perphas up to 100 hours.

| | |
|---|---|
| manganese | 12.5% |
| molybdenum | 4.0% |
| carbon | 0.02% max |
| sulphur | 0.02% max |
| silicon | 0.02% max |
| phosphorus | 0.01% max |

Following vacuum melting to the above composition this steel was treated by subjecting the steel to an initial solution treatment for 1 hour at 900° C., air cooling and quenching in liquid nitrogen before maraging for 5 hours at 450° C.

The above heat treatment produced a steel having the following properties:

| | |
|---|---|
| 0.1% proof stress | 1150 $MN/m^2$ |
| tensile strength | 1450 $MN/m^2$ |
| % elongation | 30 |
| % reduction of area | 70 |
| toughness (C.V.N.) | 85 J |
| hardness | 430 HV |

One advantage of the present invention is that retention in the steel of the second phase acts as a scavenger and permits more tolerance in the selection of the purity of the iron source used. Lower grades of starting materials can, therefore, be used when this second phase is present.

Also, because higher impurity levels can be tolerated it is possible to make high strength steels of an acceptable quality, by air melting which makes processing considerably easier and cheaper.

As a result, the steel of the present invention will be cheaper than conventional steels having comparable strength and toughness.

Another factor contributing to a lower cost product is the use of manganese in place of nickel.

Steels having a yield stress of up to 800 $MN/m^2$ with notch toughness of over 100 joules Charpy V-notch (C.V.N.) can be produced without the need for maraging following solution treatment, if the balance between carbon and manganese is tailored so that manganese is in the range 11–12% while carbon is maintained at between 0.02% and 0.12%. This has obvious advantages in terms of energy and, therefore, cost saving and the quantity of molybdenum required is the same or less than in the maraging formulation.

A steel containing manganese and molybdenum as described and in which the second phase is retained after solution treatment, has the added advantage that high strength can be achieved by cold working to bring about the transformation of the retained $\delta$ second phase $\gamma$ phase.

Further examples of manganese steels according to this invention and heat treatment processes therefore are set out below:

1. A steel prepared from pure materials by vacuum melting followed by an initial solution treatment and maraging:

COMPOSITION

| C | Mn | Mo | S | P | Si |
|---|---|---|---|---|---|
| 0.012 | 12.95 | 5.95 | 0.01 | 0.04 | 0.01, Balance Fe |

Alloy Grade: Commercially pure (Electrolytic iron base)

Method of Manufacture: Vacuum Melting.

Heat Treatment: Solution treatment of 1 hour at 900° C. followed by a maraging treatment of 5 hours at 450° C.

Mechanical Properties (Room temperature):

| T.S. ($MN/m^2$) | Y.S. ($MN/m^2$) | El % | R.A. % | Charpy V-notch C.V.N.(J) | HV30 |
|---|---|---|---|---|---|
| 1350 | 1155 | 29 | 64 | 85 | 427 |

Impact Properties: (Low temperature): 80 J. C.V.N. at −70° C.

2. A steel prepared from pure materials by vacuum melting following by solution treatment only:

COMPOSITION

| C | Mn | Mo | S | P |
|---|---|---|---|---|
| 0.004 | 12.0 | 4.2 | 0.009 | 0.003, Balance Fe. |

Alloy Grade: Commercially pure (Electrolytic iron base).

Method of Manufacture: Vacuum melting.

Heat Treatment: Solution treatment of 1 hours at 900° C.

Mechanical Properties: (Room temperature):

| T.S. ($MN/m^2$) | Y.S. ($MN/m^2$) | El % | R.A. % | C.V.N.(J) | HV30 |
|---|---|---|---|---|---|
| 1054 | 812 | 33 | 72 | 200 | 341 |

Impact Properties: (Low temperature):
160 J C.V.N. at −70° C.;
40 J C.V.N. at −196° C.

3. A steel prepared from materials graded as impure by air melting followed by solution treatment and maraging:

Alloy Composition:

| C | Mn | Mo | S | P | Si |
|---|---|---|---|---|---|
| 0.10 | 11.82 | 4.79 | 0.020 | 0.019 | 0.14, Balance Fe. |

Alloy Grade: Impure (Mild Steel Base).

Method of Manufacture: Air melting.

Heat Treatment: Solution treatment of 1 hour at 900° C. followed by a maraging treatment of 5 hours at 450° C.

Mechanical Properties: (Room temperature):

| T.S. ($MN/m^2$) | Y.S. ($MN/m^2$) | El % | R.A. % | C.V.N.(J) | HV30 |
|---|---|---|---|---|---|
| 1445 | 1100 | 20 | 25 | 52 | 462 |

Impact properties: (Low temperature):
50 J C.V.N. at −50° C.;
40 J C.V.N. at −100° C.

4. A steel prepared from commercially pure materials by air melting solution treatment and maraging:

Alloy Composition:

| C | Mn | Mo | S | P | Si |
|---|---|---|---|---|---|
| 0.02 | 12.73 | 4.50 | 0.008 | 0.008 | 0.10, Balance Fe |

Alloy Grade: Commercially pure (Electrolytic iron base).

Method of Manufacture: Air Melting.

Heat treatment: Solution treatment of 1 hour at 900° C. followed by a maraging treatment of 5 hours at 450° C.

Mechanical properties: (Room temperature)

| T.S. ($MN/m^2$) | Y.S. ($MN/m^2$) | El % | R.A. % | C.V.N.(J) | HV30 |
|---|---|---|---|---|---|
| 1320 | 1050 | 26 | 50 | 56 | 418 |

Impact Properties: (Low temperature):
58 J C.V.N. at −50° C.
32 J C.V.N. at −100° C.

5. A steel produced from materials graded as impure, by solution treatment followed by old working:

Alloy Composition:

| C | Mn | Mo | S | P | Si |
|---|---|---|---|---|---|
| 0.08 | 13.40 | 6.59 | 0.021 | 0.004 | 0.063, Balance Fe. |

Alloy Grade: Impure

Method of Manufacture: Vacuum melting.

Heat Treatment: Solution treatment of 1 hour at 900° C. followed by a cold working treatment amounting to 33% reduction in area.

Mechanical Properties: (Room temperature):

| T.S. ($MN/m^2$) | Y.S. ($MN/m^2$) | El % | R.A. % | C.V.N.(J) | HV30 |
|---|---|---|---|---|---|
| 1860 | 1800 | 13 | 45 | 16 | 560 |

6. A steel produced from materials grades as pure by vacuum melting, followed by solution treatment and cold working:

Alloy Composition:

| C | Mn | Mo | S | P | Si |
|---|---|---|---|---|---|
| 0.013 | 13.59 | 5.97 | 0.012 | 0.004 | 0.040, Balance Fe. |

Alloy Grade: Commercially pure

Method of Manufacture: Vacuum melting

Heat Treatment: Solution treatment of 1 hour at 1000° C. followed by cold working treatment amounting to 45% reduction in area.

Mechanical Properties: Room temperature:

| T.S. ($MN/m^2$) | Y.S. ($MN/m^2$) | El % | R.A. % | C.V.N.(J) | HV30 |
|---|---|---|---|---|---|
| 1550 | 1520 | 10 | 66 | 80 | 446 |

In the foregoing examples and during manufacture, after vacuum or air melting, the steel in each example was reduced by hot working by not less than 70% reduction of its original cross-sectional area.

The advantageous properties of a cast steel made in accordance with the present invention will depend inter alia on a reasonably fine grain size which is usually but not necessarily achieved by hot working the steel prior to solution treatment. However, although the properties attainable in the as cast or heat treated condition compare favourably with other steels in that condition, nevertheless in order to optimise the properties of cast material, a homogenisation anneal of two to three hours at a temperature of 1200° to 1250° C. is recommended before the standard heat treatment cycle is applied.

We claim:

1. A manganese steel consisting essentially of apart from impurities, 11.8–13.5% by weight manganese, 2.0–6.0% by weight molybdenum, 0.002–0.2% by weight carbon, and optionally one or more of silicon (up to 0.4% by weight), sulphur (up to 0.02% by weight) and phosphorus (up to 0.03% by weight) and balance iron.

2. A manganese steel according to claim 1 wherein the molybdenum is wholly or partially replaced by tungsten in an amount of 2 to 10 weight %.

3. A manganese steel according to claim 1 or claim 2 including from a trace to 0.2 weight % of at least one of the metals aluminum, titanium and mischmetal.

4. A manganese steel according to claim 1 comprising, apart from impurities, manganese 12.5%, molybdenum 4.0%, carbon 0.02% maximum, sulphur 0.02% maximum, silicon 0.02% maximum and phosphorus 0.01% maximum.

* * * * *